US005445275A

United States Patent [19]

Curley et al.

[11] Patent Number: 5,445,275

[45] Date of Patent: Aug. 29, 1995

[54] FULL RECOVERY REDUCED-VOLUME PACKAGING SYSTEM

[75] Inventors: Dennis M. Curley, Brea; Chris M. Boos, Studio City, both of Calif.

[73] Assignees: Lazy Pet Products, Inc.; Southern California Foam, Inc., Brea, Calif.

[21] Appl. No.: 255,483

[22] Filed: Jun. 8, 1994

[51] Int. Cl.[6] ..... B65D 85/00

[52] U.S. Cl. ..... 206/525; 206/524.8

[58] Field of Search ..... 206/524.8, 525, 438; 383/100

[56] References Cited

U.S. PATENT DOCUMENTS

| | | | |
|---|---|---|---|
| 4,418,514 | 12/1983 | Spann | 206/524.8 |
| 4,449,632 | 5/1984 | Marusiak, Jr. | 206/524.8 |
| 4,640,080 | 2/1987 | Wright | 206/524.8 |
| 4,928,829 | 5/1990 | Di Bernardo | 206/524.8 |
| 5,203,458 | 4/1993 | Cornwell | 383/100 |
| 5,339,959 | 8/1994 | Cornwell | 206/524.8 |

FOREIGN PATENT DOCUMENTS

| | | | |
|---|---|---|---|
| 4114867 | 4/1992 | Japan | 206/524.8 |
| 4201883 | 7/1992 | Japan | 206/524.8 |
| 4242544 | 8/1992 | Japan | 206/524.8 |

*Primary Examiner*—David T. Fidei
*Attorney, Agent, or Firm*—Luke Santangelo

[57] ABSTRACT

A packaging system including both methods and specific types of packaging addresses the need for a fully recoverable, reduced-volume packaging of compressible items. The system may involve initially compressing the item through folding and the like and wrapping the item for insertion into a bag or other flexible impermeable encasing. This bag may then be compressed externally or through evacuation and sealed so that the flexible impermeable encasing acts in conjunction the ambient pressure environment to hold the item in a fully compressed state. For ease of sealing the bag the entire package may be subjected to lower pressures and then sealed. In this manner the item is sealed prior to compression. In order to achieve full recovery of the item the compressible item may be constructed of an open-cell foam having a density at least greater than 1.2 pounds per cubic foot. Alternatively for particularly immediate recovery and for full recovery even after long storage periods the density of such open-cell foam may be about 2.0 pounds per cubic foot. Upon exposure to the ambient pressure environment the item becomes fully compressed and may be packaged for distribution. Convenient opening means may be included on a pre-established seal on a pre-sized bag which just fits the initially compressed item. One or more foam pet products might be packaged in a single package in a manner which greatly reduces the volume necessary for inventory or shipping.

18 Claims, 8 Drawing Sheets

FULL RECOVERY REDUCED-VOLUME PACKAGING SYSTEM

BACKGROUND OF THE INVENTION

Generally, this invention relates to a packaging system for and techniques of compressing items in an economical manner and in a manner which allows full recovery of the particular item compressed. Specifically, the invention focuses upon techniques and packaging for the pet industry where larger volume, compressible items are fairly common.

The desire to compress items for shipping and storage has been known in some industries for many years. In a basic form, the concept involves taking a compressible item such as a product substantially made of foam and compressing that item so that in either shipping or storage it consumes much less volume and is therefore less expensive and more economical to provide to the customer. Such a technique offers advantages throughout the distribution cycle. To the manufacturer, the distributor, and the retailer compressed products take up only a small fraction of the volume of the fully expanded product and thus allow more economical use of both inventory and retailing spaces. To the consumer, not only does the product consume less space in transportation, but it can also provide some degree of entertainment when the package is initially opened and the item becomes uncompressed. At the point of purchase, the consumer is not hindered by the compressed state of the particular item, and in fact may be reassured by it, since not only can they either see a picture or an actually uncompressed item, but they may also find some comfort in knowing that the item has not been damaged, utilized, or exposed to dirt or germs prior to their purchase. While this basic concept seems quite simple, implementation is not so straightforward. To the contrary, simple compression in a practical manner which is economical for all those involved in the distribution cycle and which provides an untainted product to the consumer is attended by a great variety of challenges and problems.

Perhaps one of the most significant problems that those in some fields have faced is the fact that once compressed the item tends to want to uncompress to its natural state. As a result a variety of efforts have been directed toward techniques which hold the item in the compressed state. Naturally, the greater the degree of compression, the greater the need for a restraining system. Efforts in this regard include those disclosed in U.S. Pat. No. 4,016,707 (and subsequent U.S. Pat. No. Re. 30,893) which includes a design having a small enough opening to allow sufficient time to insert the item into a restraining container. In similar fashion U.S. Pat. No. 3,968,620 provides for simultaneously compressing the item and urging it into a container which might even include a rigid container. Not only do such systems unnecessarily require structurally strong containers, but they also may involve unnecessary expense (for the container which is ultimately disposed of) and may involve unnecessarily complicated steps in the manufacturing process.

As shown in U.S. Pat. No. 3,968,620, it has been known to utilize vacuum in order to achieve compression. One of the problems with such a technique, however, is that once compressed it is difficult to economically seal the encasing in which compression occurred. Presumably this is one reason why the invention disclosed in U.S. Pat. No. 3,968,620 provides simultaneously urging the compressed item into a rigid container. While some designs such as that disclosed in U.S. Pat. No. 3,641,726 incorporate some type of valve mechanism such solutions have not been entirely acceptable due to the fact that the container itself is typically disposed of as soon as the package is opened. (It also compresses in a flat manner which does not minimize the volume of the item.) A very clear statement of the problem of sealing a compressed encasing is made in U.S. Pat. No. 3,307,319 which states that sealing is difficult since "no practical way of eliminating the rumpling has been found." Thus, as a solution this particular system utilized an external restraint which structurally held the item in its compressed state. The present invention overcomes the limitations of such an approach.

At least two problems have presented themselves from the consumer's perspective which are solved by the present invention. First, from the consumer's perspective one of the most difficult problems for such items was the fact that when substantially compressed many items would either take too long to recover or would not fully recover. Although full recovery in a very short time frame, even after long storage, has been almost universally desired, until the present invention this goal was not practically achievable. This has been due in part to the fact that those involved in the compression of products did not understand that the particular foam was very important in determining recovery. To some degree those involved were lead away from the solutions of the present invention. For instance, U.S. Pat. No. 3,968,620 actually teaches that any type of foam is acceptable and that lower density foams are preferred. The present invention teaches that this is not, in fact, true.

A second problem from the consumer's perspective has been the desire for the item to be easily removed from the container. Since the items inherently try to uncompress, they tend to stick to any encasing. Again, the present invention solves this problem in a manner which meets consumer's desires.

In systems which utilize vacuum or low pressure to achieve compression, uniform removal of the air has also been desired. Since the item typically compresses while the air is being removed, it has been a challenge to avoid pockets or other blockages which do not allow uniform compression. Solutions to this problem have involved complex mechanisms such as that proposed in U.S. Pat. No. 3,889,444 in which a cone-shaped chamber and other designs are included in order to assure uniform evacuation in the vicinity of the item. Again the present invention solves this problem in a manner which is simple and economical.

As relating to the compression of products in general, certainly there are other problems which have arisen and which are solved by the present invention ranging from the need for a simple opening system to the need to be able to compress multiple products at one time and into one package. As discussed in other aspects of the specification and claims the present invention solves a host of different challenges in a manner which is both economical and acceptable to the consumer. As can be seen, many of these involve the proper combination of features to function together to achieve the desired result.

A key application of the present invention is that of the pet industry. A significant aspect of the pet industry includes the use of items made of foam such as pet beds and the like. As to these items and this industry, prior to the present invention impediments to the distribution cycle included not only the space that such items occupy in shipping but also the space which they occupy in an inventory or retail setting. In spite of the fact that other industries have utilized techniques to minimize the mount of space required, the pet industry has not previously realized that these techniques were applicable to their industry in an economical manner. The previous efforts from unrelated fields simply were not recognized as being practically applicable by those in the pet industry. This is perhaps due in part to the fact that the pet industry is a very specialized field which caters to customers that have very different needs and desires from other consumers of foam-based products. As a result, rather than utilizing techniques available to other industries, those involved in the pet industry have focused their attention more on their own industry and its potentially unique requirements. As a result this one industry has overlooked solutions to long recognized problems even though some solutions may have been available from other fields. In this industry alone it can be seen that while those skilled in the art recognized the challenges of their high-volume products, they did not fully appreciate that the problem lay in a practical technique to compress the products during the distribution cycle and in a practical technique to allow them to be fully uncompressed either in order to provide them to the consumer or after actually being purchased by the consumer.

As to both the pet industry and the overall desire to compress products, the present invention discloses techniques which overcome virtually every one of the previous problems in a practical fashion. Perhaps surprisingly, it satisfies a long-felt need to achieve economical and efficient compression of products for packaging through the implementation of techniques and elements that had long been available. To some degree, even those involved in the compression of products for packaging in other industries had not fully appreciated that the problems of sealing and recovery could be solved by either the proper selection of material or the utilization of the appropriate technique for compression. Obviously, substantial attempts had been made in order to solve the problems that those in various industries had faced in attempting to practically compress products. In spite of those attempts, until the present invention no techniques were available which practically solved the spectrum of challenges which this seemingly simple task entailed. In fact, even the efforts pursued acted to teach away from the directions which the present invention takes in that they either utilized the wrong material, attempted to restrain a compressed package through structural restraint, or in general were not able to provide a packaging system which was both economical and met the needs of the end users.

SUMMARY OF THE INVENTION

The present invention includes a variety of aspects which may be selected in different combinations based upon the particular application or needs to be addressed. In one basic form, the invention discloses the use of an open cell foam having density greater than 1.2 pounds per cubic foot. This particular type of a foam has been found to not only achieve rapid recovery but also to achieve full recovery even in instances in which the package has been maintained in a compressed state for a relatively long period of time. A second aspect of the invention is that it allows for a packaging system in which the compressed item is held in the compressed state through an impermeable encasing even when compression has been achieved through the utilization of low pressures or evacuation. The invention also provides for a system in which low pressure or evacuation is achieved prior to compression of the item so that a seal on the impermeable encasing can be achieved prior to the "rumpling" which others had experienced. Another independent aspect of the invention is that it provides for a system in which both packaging and unpackaging are made simpler for those involved through the use of some type of intermediate wrapping. This wrapping can be achieved to make the product more sphere-like so as to allow maximum compression when accomplished through an evacuation or low-pressure technique. The invention also includes aspects such as the proper sizing of the bag and an opening means to facilitate the most efficient design. Finally, the inclusion of multiple compressed items in one package as well as the particular application to a unique industry—the pet industry—is included. Naturally, as a result of these several different and potentially independent aspects of the invention, the objects of the invention are quite varied.

One of the broad objects of the invention is to allow for a packaging system which is acceptable from the consumer's perspective. Thus one goal includes achieving maximum compression yet allowing immediate recovery of the item when opened. Further, beyond just quick recovery is also total recovery. Thus a goal is to allow full recovery even when the item has been stored in a compressed state for a relatively long period of time. To achieve these, one goal is to provide for the selection of a peculiarly appropriate foam or compressible material.

Another broad goal of the invention is to provide for packaging that consumes less volume than the total uncompressed item. While this has obviously been achieved in other manners, a goal of the present invention is to achieve this in an economical and efficient manner which properly balances the interests of those involved in the distribution cycle and the interests of consumers. Thus one of the goals is to hold a collapsed or compressed product without unnecessary structure even when it has been compressed through evacuation. Further, it is a goal to easily and effectively seal the encasing in instances when compression causes "rumpling" of such encasing.

In keeping with the prior goal of meeting the consumer's needs, it is a goal to provide a packaging system which is both easily made and used. Thus one goal is to allow for maximum compression in an easy manner from the manufacturer's perspective. At the other end of the spectrum it is also a goal to allow for easy removal of the item by the consumer or the retailer. Each of these goals is met by providing a wrapping which both holds the item in the appropriate shape for insertion and allows easy removal from its encasing after it has been decompressed.

Yet another goal is to allow for efficient use of a compression packaging system in multiple products applications. This includes the goal of allowing for packaging of more than one item in one package as well as the goal of allowing for more than one package to be compressed and created in one manufacturing action.

Naturally further objects of the invention are disclosed throughout other areas of the specification and claims.

BRIEF DESCRIPTION OF THE DRAWINGS

FIG. 1A shows the item uncompressed. FIG. 1B shows the item initially compressed through folding and wrapping. FIG. 1C shows the item in a fully compressed state.

FIG. 2A shows the item in an uncompressed state; FIG. 2B shows a wrapping; FIG. 2C shows a bag encasing.

DETAILED DESCRIPTION OF THE PREFERRED EMBODIMENTS

Figure 1C:
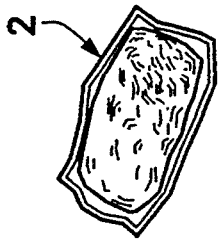
FIGS. 1A–C are photos of a sequence of one item which has been compressed according to one embodiment of the invention.
Figure 1B:
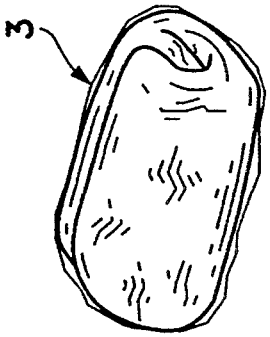
Figure 1A:
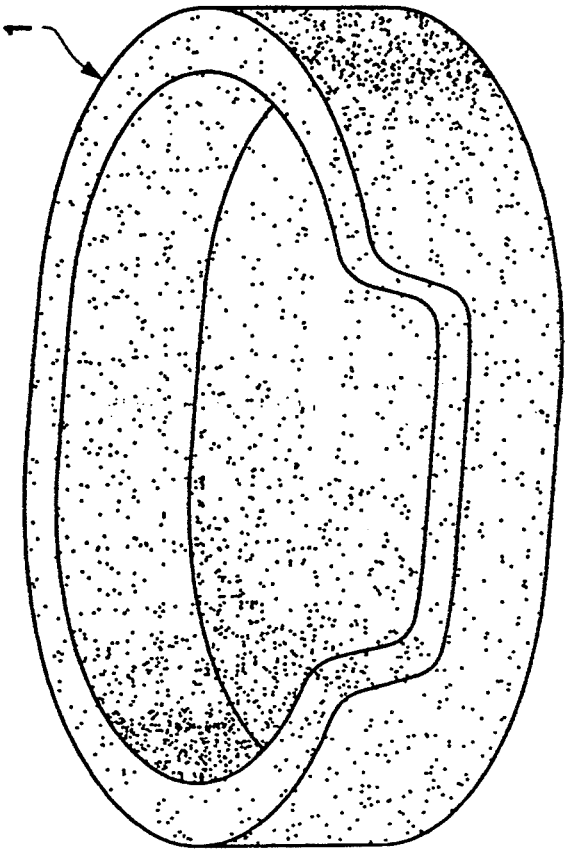

As mentioned earlier, the present invention includes a variety of aspects which may be combined in different ways. Each of these aspects is first discussed separately. As shown in FIGS. 1A–C, the invention involves providing a compressible item (1) and packaging it in a reduced volume manner so as to make a "fully" compressed item (2). As shown in FIG. 1B, this may be achieved through some intermediate step which creates an initially compressed item (3). With respect to compressible item (1), the item should be capable of being resiliently compressible, that is that it should achieve a reduced-volume state and yet resiliently be able to fully recover to its original state. This recovery should not only occur quickly as discussed earlier, but it should be a complete recovery.

Type of Foam

A surprising aspect of the present invention was discovered in ascertaining the appropriate type of material to use. From these efforts, it has been discovered that at least one seemingly unrelated characteristic can be used to assure that the compressible material completely meets the two goals of quick recovery and complete recovery. Specifically, it has been discovered that by specifically selecting material which will be compressed limited to open cell foam having a density greater than 1.2 pounds per cubic feet is satisfactory, quick and complete recovery can be almost assured. In this regard, the greater density selected, the better the recovery of the item. Densities of about 1.4 to 1.8 pounds per cubic foot lessen the amount of time of recovery. Further, it has been discovered that when the density is about 2.0 pounds per cubic foot, truly optimum results are achieved.

Since there may be instances in which the density of foam utilized may need to be varied for the particular application, each of the ranges are possible when compressing products according to this invention. Importantly, it has been discovered that whenever a density is less than 1.2 pounds per cubic foot, completely unacceptable results occur and the packaging system does not meet with commercial acceptance. The discovery that variation in density actually can be used to determine the recovery of a compressed product is perhaps surprising for a number of reasons. First, while those involved in compressing items for packaging may have utilized a variety of materials, prior to the present invention they did not appreciate the impact that the control of density has on the ability of the item to recover from its compressed state. Certainly those involved have specified items such as polyurethane foam and the like (a type of foam which is utilized in the present invention) but this specification alone has not proved to be sufficient and may have even contributed to the fact that compressing foam items for packaging has not met with as universal an acceptance as expected. Further the selection of the product should be made specifically, not by accident, so that appropriate quality and customer satisfaction is assured.

Density is not the only characteristic which can impact recovery. It has also been discovered that the use of particular additives such as fire retardant can also have effects upon the ability of the item to recover from a compressed state. Again, perhaps surprisingly, it has been discovered that when fire retardant is added to a particular foam it may actually assist the product in its recovery and may allow it to be more appropriate as a compressed packaging material.

In characterizing compressible item (1) it should be understood that compressible item (1) may include materials other than open cell foam having density greater 1.2 pounds per cubic foot and yet still be compressed. For instance, it is possible to include a mix of foam and other products such as cedar chips or the like and still compress the item. In instances in which these combinations may include foam scraps, care should be taken to avoid including scraps which have an inappropriate density or incomplete recovery may result. If this is not economically possible, convoluted foam may be used (in an item such as a pet bed) to achieve the desired look and feel without being required to include inappropriate foam material. Any portion of the item subjected to compression should not include a substantial amount of compressible open cell foam which has density less than 1.2 pounds per cubic foot or the ultimate recovery of the item may be negatively impacted. This is especially true when, as explained later, evacuation is accomplished prior to compression since the entire item is compressed very efficiently. By limiting the amount of low density foam to insubstantial amounts (amounts which are either not necessary or noticeable should they either take a long time to uncompress or not fully recover), the end product can be assured of meeting the consumer's expectations.

Figure 2B:
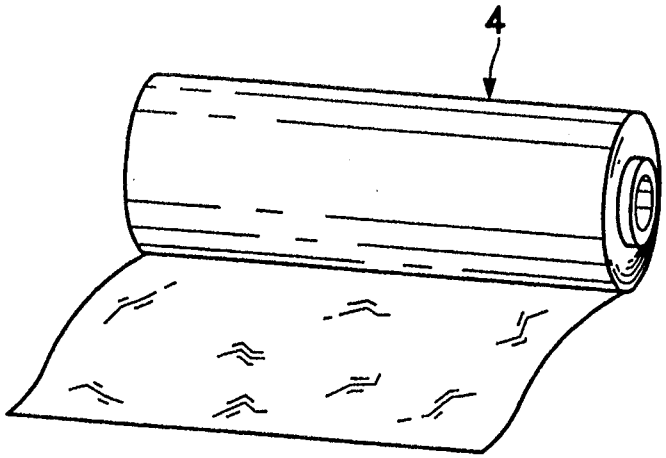
FIGS. 2A–C are photos and a drawing representing an exploded view of the components of a package prior to compression.
Figure 2C:
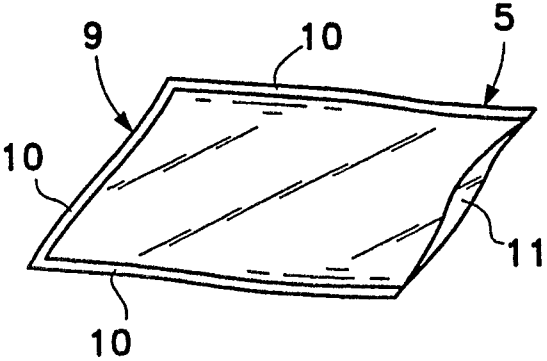
Figure 2A:
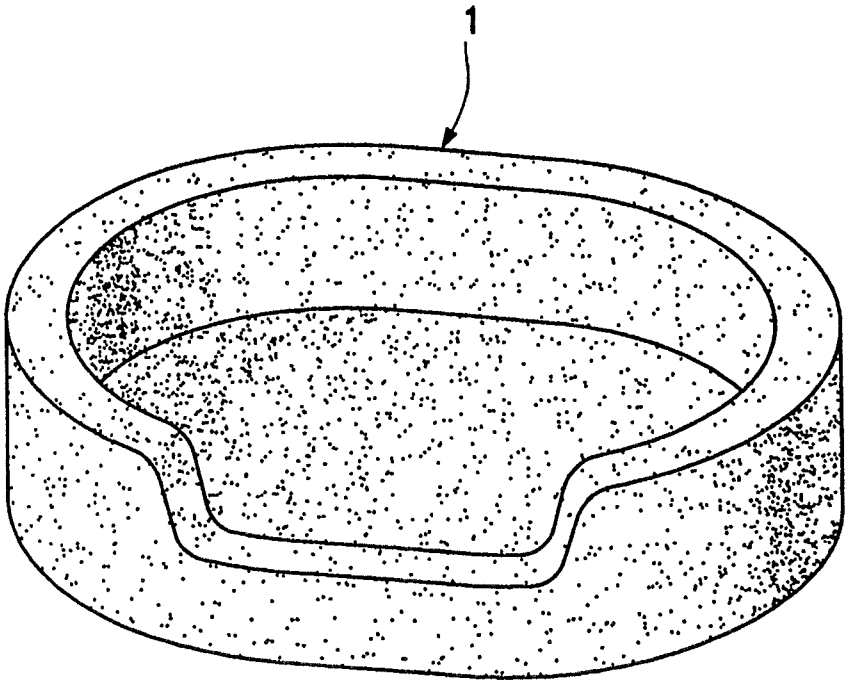
Figure 4:
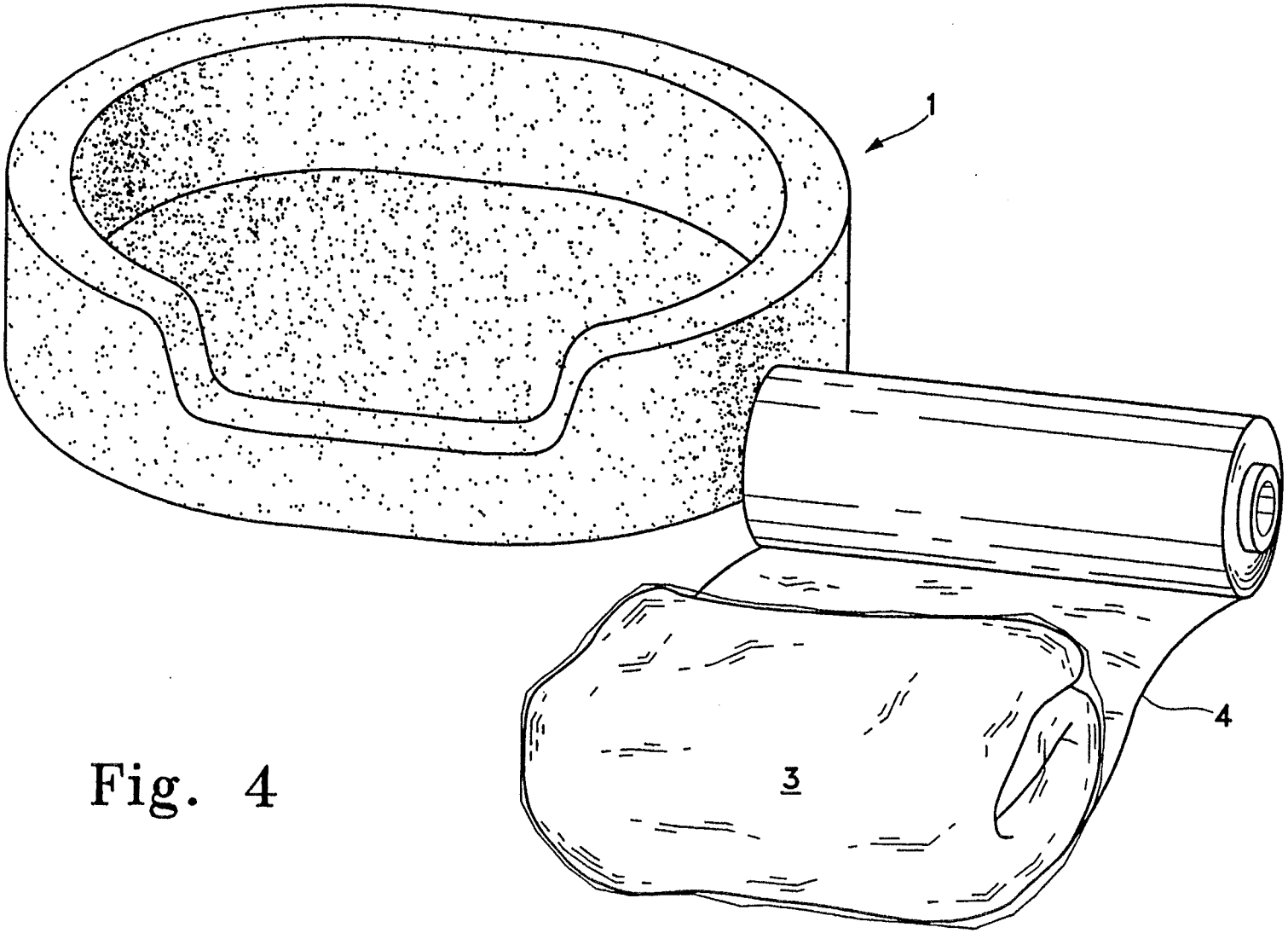
FIG. 4 is a photo of a perspective view of a product such as that shown in FIG. *2a* after it has been folded and wrapped according to one embodiment of the invention.

To achieve a compression according to the present invention the item may be compressed either through an external compression means or through some type of evacuation technique. External compression has been explained in several of the cited references. Referring to FIGS. 2A through 2C, the unique evacuation technique of the present invention can be easily understood. First, compressible item (1) may be initially compressed. This can occur mechanically, by hand, or when wrapping it in a flexible sheet-like material (4) as shown in FIG. 4. In achieving this wrapping, compressible item (1) may be folded so as to create initially compressed item (3). As shown in FIG. 4, this folding and wrapping may be done in such a manner so as to make compressible item (1) more spherical after it has been transformed into initially compressed item (3). As seen in FIG. 4 initially compressed (3) is not completely spherical but rather just more spherical than the natural uncompressed state of compressible item (1).

The step of initially compressing the item facilitates both manufacture and utilization. FIG. 4 shows the item folded to make it more spherical and wrapped with a flexible sheet-like material (4). This flexible sheet-like material (4) and wrapping may have several important properties. First as can be appreciated from Figure (4), flexible sheet-like material (4) may be used to substantially encircle the item to be compressed.

Another property desirable for the wrapping is useful in the event it has been selected to initially compress compressible item (1). In such instances, it may be convenient to select flexible sheet-like material (4) from materials exhibiting the property of having high friction with respect to itself. Thus, like many cellophane wraps, flexible sheet-like material (4) can actually serve to hold compressible item (1) in its initially compressed state and facilitate other steps which are necessary to achieve full compression. By the term high friction, it is meant that flexible sheet-like material (4) might cling to itself sufficient enough so that the natural tendency of initially compressed item (3) might not be so strong so as to overcome the ability of flexible sheet-like material (4) to hold it in the desired state at least temporarily. This wrapping can thus serve as one way of serving to create and maintain the state of initially compressed item (3).

Referring to FIG. 2C, it can be understood that in order for the full compression to occur, the item may be substantially surrounded by a flexible impermeable encasing (5). Importantly, this flexible impermeable encasing (5) needs to be both flexible and impermeable. It is flexible so that when compression occurs it can conform to the reduced-volume state created. It must be impermeable so that once the item has been compressed it does not leak and thus allow the external ambient pressure environment to leak into the package and allow it to uncompress prematurely.

As should be easily appreciated, there are a great variety of devices and items which may serve as flexible impermeable encasing (5). While shown in FIG. 2C as essentially a bag, additionally two sheets which may ultimately be sealed together around their edges or other types of arrangements may be utilized. Once substantially surrounded by flexible impermeable encasing (5), compressible item (1) may be fully compressed. As can be easily appreciated, some heating means could seal the two flat sheets and thus create the entire encasing. The utilization of a bag (9) as mentioned later, however, allows for simplified manufacture.

Figure 5:
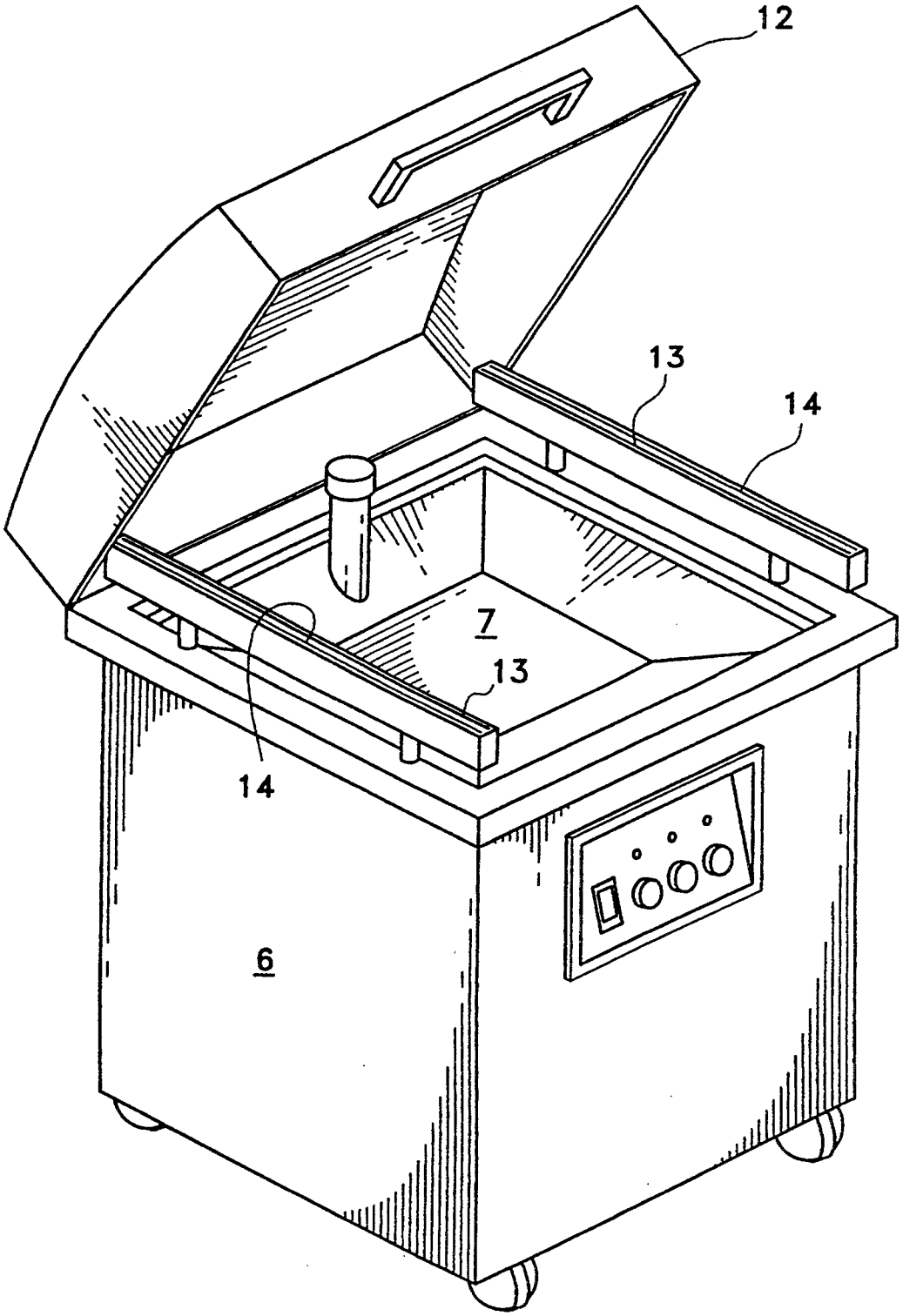
FIG. 5 is a photo of one type of low pressure chamber which may be use in one embodiment of the invention.
Figure 6:
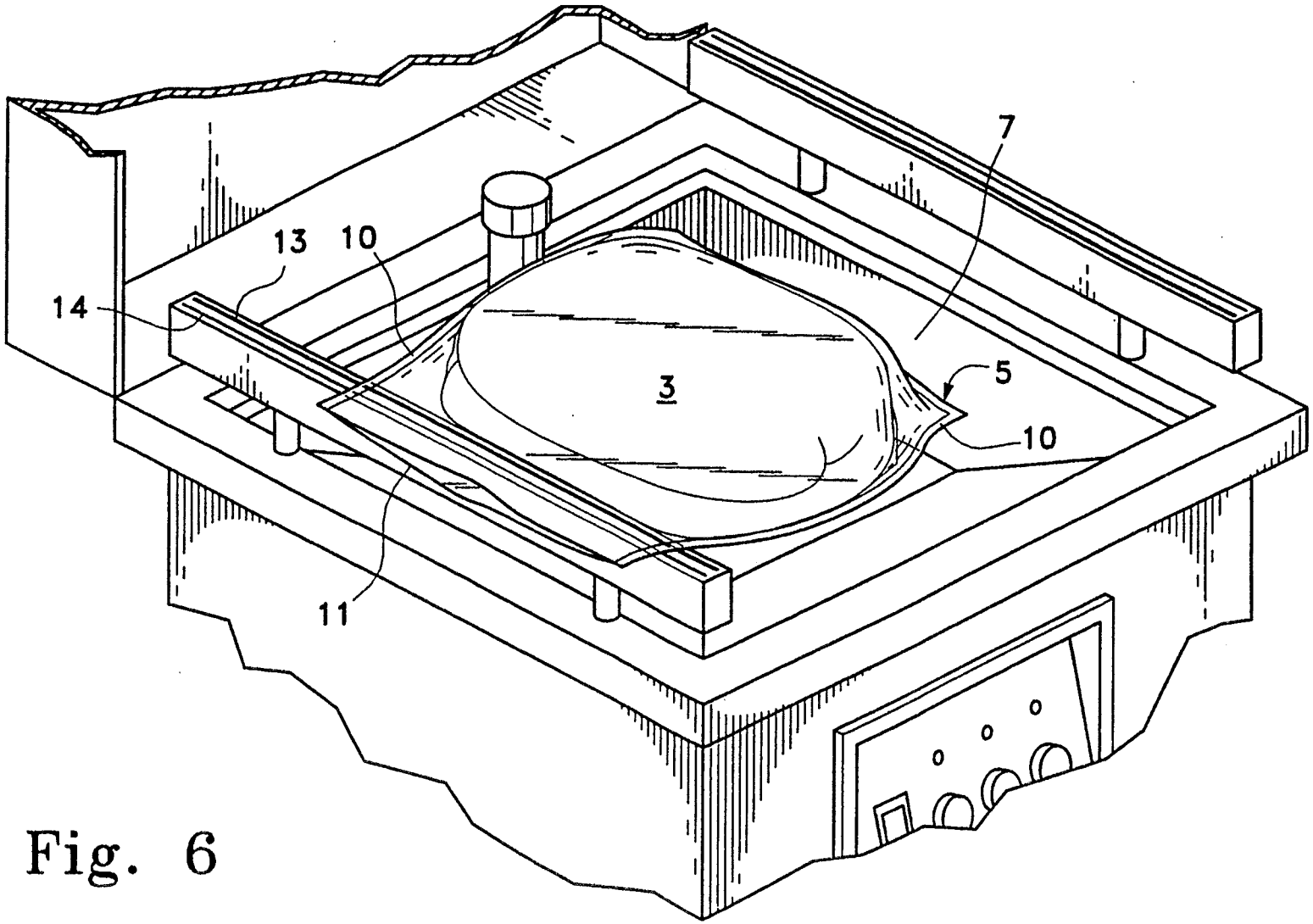
FIG. 6 is a photo of a perspective view of a package placed in the low pressure chamber prior to compression.

To fully compress the item in accordance with one embodiment of the invention, the pressure to which compressible item (1) is subjected may be reduced. Referring to FIGS. 5 and 6, one technique of achieving a reduction in volume can be understood. FIG. 5 shows low pressure chamber (6) into which the substantially surrounded item might be placed. As can be appreciated, low pressure chamber (6) should include some type of vacuum pump or other low pressure source so as to draw air from an area into which the item has been placed. As shown in FIG. 5, this area is chamber area (7).

In creating the package, either compressible item (1) or initially compressed item (3) may then be inserted into bag (9) through bag opening (11). With respect to inner wrapping (8) mentioned earlier, another property may be understood. Specifically, it may be desirable for inner wrapping (8) to be made of a material which exhibits low friction with respect to flexible impermeable encasing (5). By the term low friction it is meant that flexible sheet-like material (4) might not stick to flexible impermeable encasing (5) when initially compressed item (3) is either inserted during the manufacturing process or removed by the consumer. As may be appreciated, this would allow easy and quick manufacture and opening and avoid any unnecessary need to completely rip open flexible impermeable encasing (5). Thus inner wrapping (8) may be situated along the outer boundary surface of initially compressed item (3) between the item and flexible impermeable encasing (5). When selecting bag (9), as an item made from polyethylene nylon film, it has been found that by selecting inner wrapping (8) to be made from blown polyvinyl chloride film, not only is there high enough friction to hold inner wrapping (8) to itself, but also inner wrapping (8) exhibits low friction with respect to bag (9).

When utilizing bag (9) as the flexible impermeable encasing it can be beneficial to size bag (9) so as to accommodate not substantially more than initially compressed item (3). Not only does this avoid any waste of material—and further provide for an economical packaging system, but it also offers advantages in the compression process itself. When the item becomes compressed, if it is held in place by an encasing which compresses with the item, that encasing will naturally wrinkle as it surrounds a lower volume. To minimize the amount of wrinkling and thus enhance compression (or at least minimize any negative effects from the bag), the item in one embodiment is initially compressed. Bag (9) is then selected so as to accommodate not substantially more than initially compressed item (3).

To achieve compression according to one embodiment, the encased item is placed within chamber area (7) as shown in FIG. 6. Lid (12) of low pressure chamber (6) is then lowered to create some type of seal and the chamber is activated. Activation of low pressure chamber (6) causes pressure within chamber area (7) to be lowered to a predetermined level. This pressure may be selected based upon the amount of compression desired. In practice it appears that the amount of compression occurs very rapidly with initial pressure changes but then drops more slowly as lower and lower pressures are achieved. For this reason it may be appropriate to balance the time that it takes to achieve lower pressures with the amount of compression desired. For the particular type of products shown in the figures, it has been found that by operating low pressure chamber (6) at a level of about 100 psi for about 20 seconds, approximately 80% compression is achieved. Importantly, as may be appreciated, compression does not occur as the pressure chamber achieves lower pressure since the entire package is subjected to the same pressure. Thus the package remains in roughly only its initially compressed state as shown in FIG. 6 throughout the entire pressure reduction. This is advantageous because it avoids "rumpling" which had so plagued prior efforts and allows the package to be easily sealed.

Figure 7:
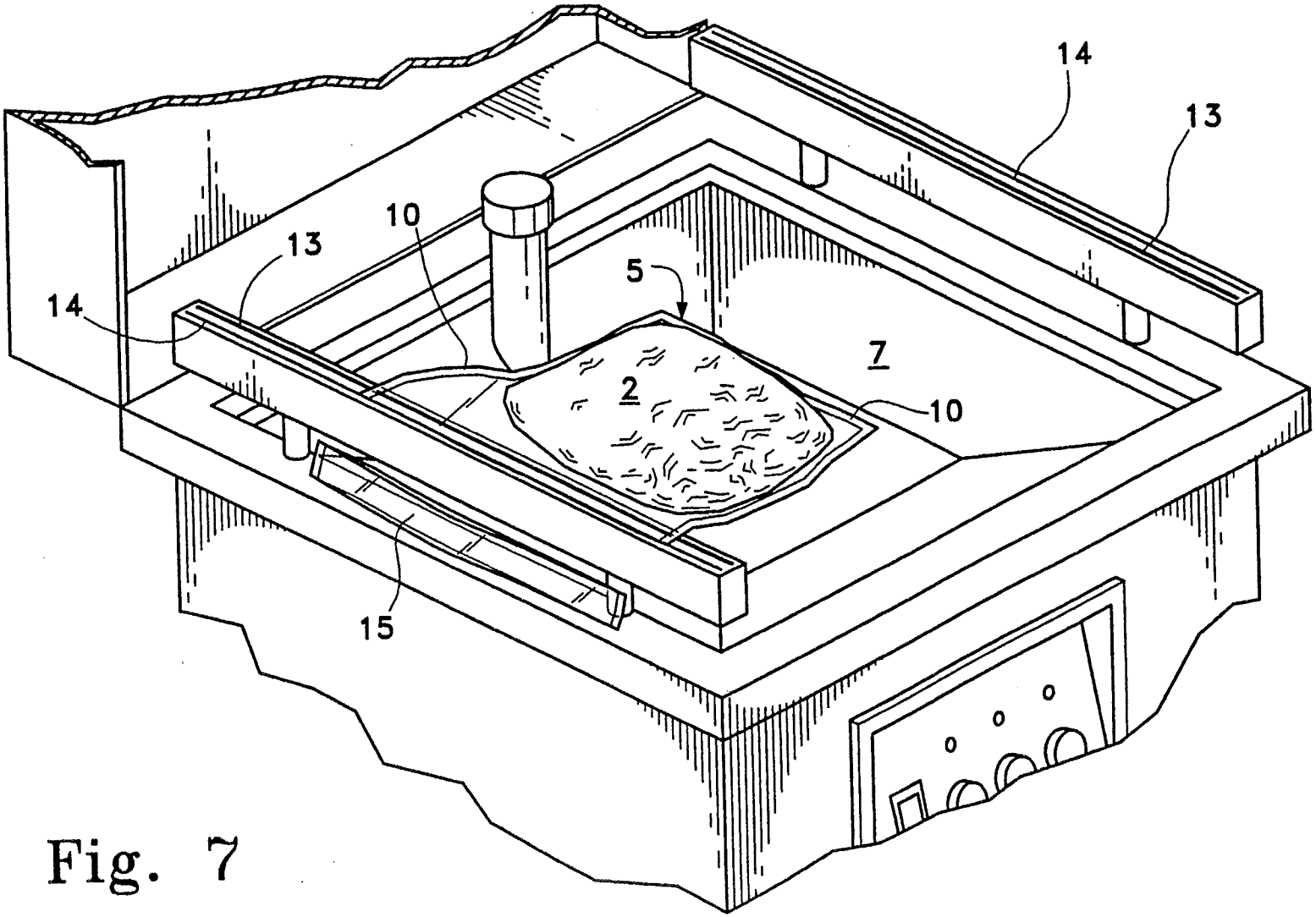
FIG. 7 is a photo of a perspective view of a package about to be removed from the low pressure chamber after compression.

As shown in FIGS. 5, 6, and 7, low pressure chamber (6) includes both sealing means (13) and trimming means (14). These can be easily understood with reference to FIGS. 6 and 7. As shown in FIG. 6, flexible impermeable encasing (5) can be placed in chamber area (7) so that bag opening (11) is positioned to place bag (9) over both sealing means (13) and trimming means (14). By placing bag opening (11) within chamber area (7), air within flexible impermeable casing (5) will exit through bag opening as the pressure within chamber area (7) is reduced. Since the exterior of flexible impermeable encasing (5) is also subjected to these reduced pressures, compression does not yet occur. Rather, flexible impermeable encasing (5) remains in roughly the same position as shown in FIG. 6. This can be assured by clamping the item within chamber area prior to and during the sealing process as well to avoid any possibility of folds in the area to be sealed.

Through proper cycling of low pressure chamber (6), sealing means (13) can be activated. This occurs by operating in conjunction with heating elements contained within lid (12) in this particular apparatus. Through timing, flexible impermeable encasing (5) can be melted, bonded, ultrasonic sealed, or otherwise affected by sealing means (13) so as to create a seal of the flexible impermeable encasing (5). This newly created seal acts in conjunction with pre-established seals (10) so as to cause a completely sealed flexible impermeable encasing (5) for the item. Once this has been achieved, trimming means (14) may be activated so as to cut excess portion (15) of flexible impermeable encasing (5). Again, by utilizing heat for merely a longer period of time (or more intense heat) excess portion (15) can be completely severed from flexible impermeable encasing (5). This is shown in FIG. 7.

Figure 3C:
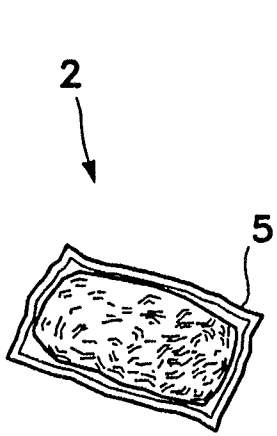
FIGS. 3A–C are drawings representing an exploded view a package showing multiple products prior to compression.
Figure 3B:
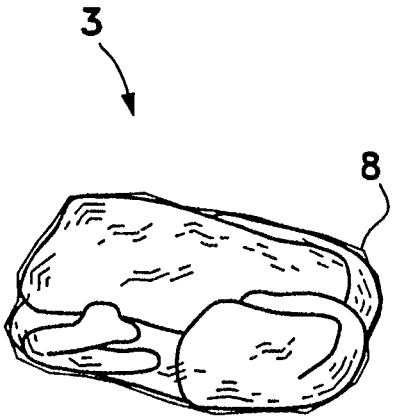
Figure 3A:
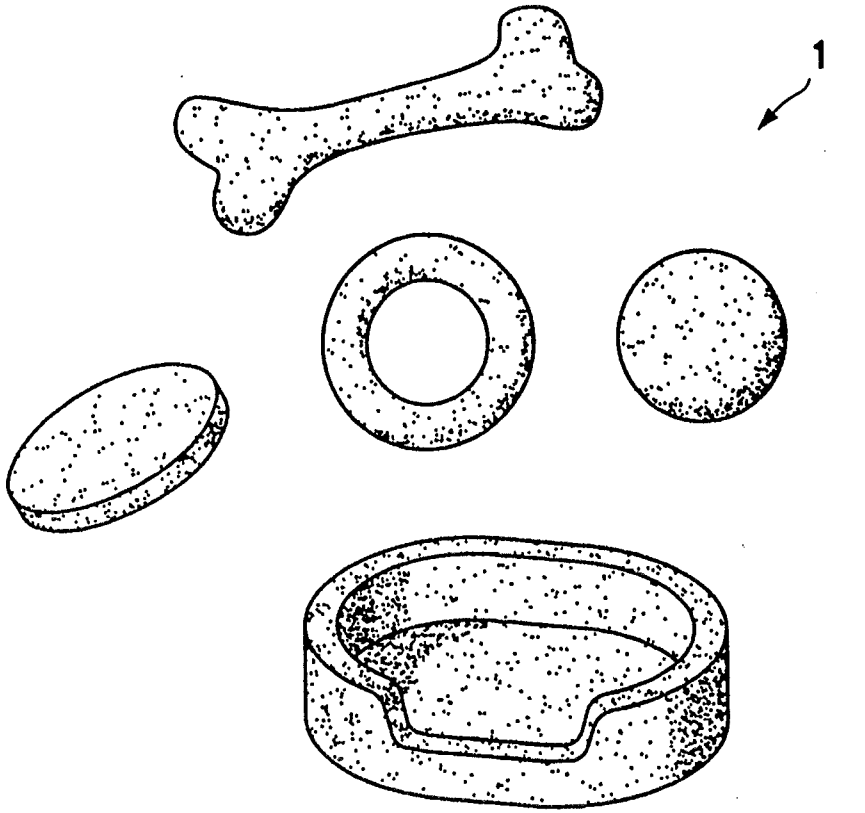

In this particular embodiment, once flexible impermeable encasing (5) has been sealed, compression may occur. This is achieved in this embodiment by exposing the impermeable encasing to ambient pressure. As this occurs, the compressible item is actually compressed and flexible impermeable encasing "rumples" in on itself. Since the item has already been sealed, however, this rumpling poses no problem. Also, since flexible impermeable encasing (5) is impermeable, it acts to hold the item in a fully compressed state by interaction between the impermeable encasing and the ambient pressure environment. The item may then be removed from low pressure chamber (6) and the process begun on another item. As can be appreciated from the type of low pressure chamber (6) shown in FIGS. 6, 7, and 8, more than one sealing means (13) and trimming means (14) may be included. From utilizing this type of low pressure chamber (6), multiple items may be sealed at once by positioning them either next to each other or on opposite sides of chamber area (7). Similarly, multiple items may be compressed at once for a single package. Referring to FIGS. 3A–C (which are not shown to scale), it can be seen that a plurality of open-cell foam products can be assembled, wrapped, and then all inserted into a single bag for single packaging similar to the process just described.

Figure 8:
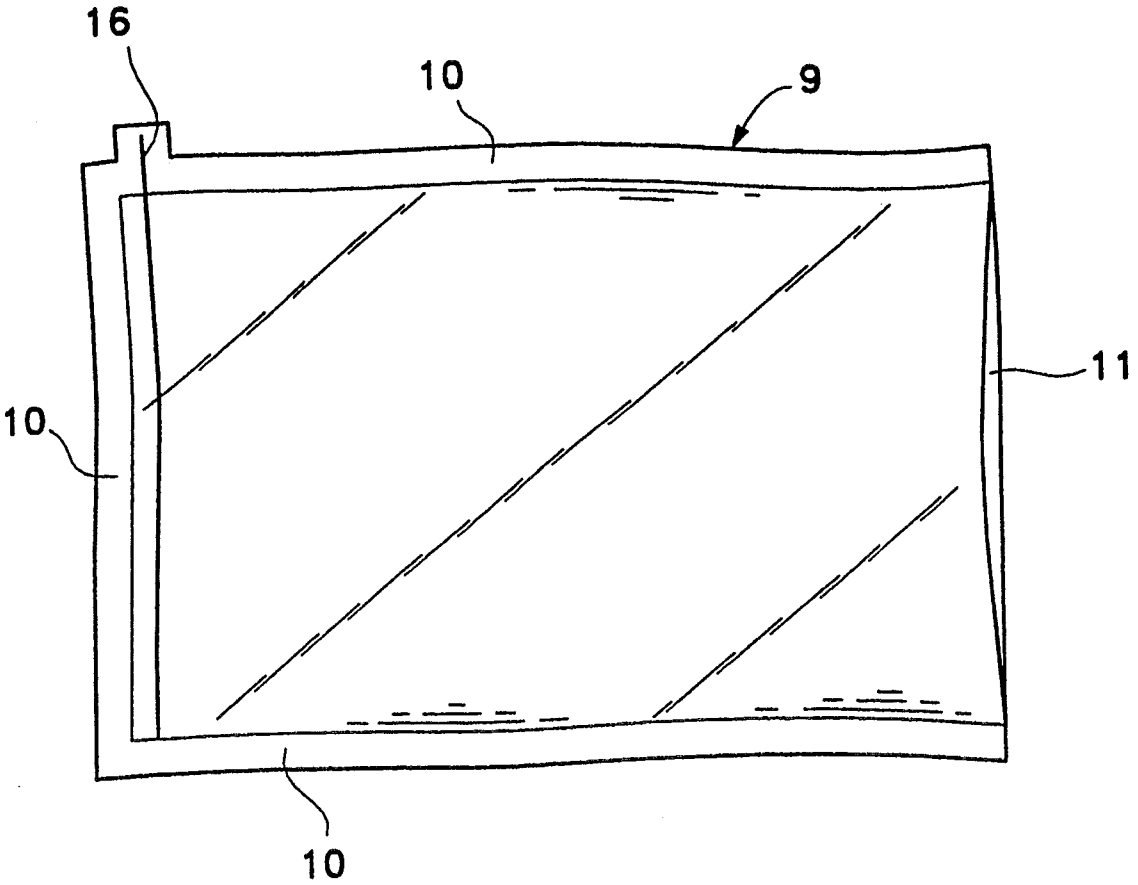
FIG. 8 is a view of a bag having one type of opening means pre-established along one edge.

Once removed from low pressure chamber (6), fully compressed item (2) may then be further packaged such as in a box. This could allow the incorporation of some type of picture to show the uncompressed item so that the consumer can understand the product which they are purchasing. Since the product is designed to be easily used by the consumer, bag (9) may include some type of opening means (16) as shown in FIG. 8. The opening means may be a weakened portion or alternatively some type of tab or string or any other of a variety of means which may be disclosed in a host of different arts. Naturally, in one embodiment, such an opening means should not negatively impact impermeability if the encasing is made to be impermeable. For simplicity, as shown in FIG. 8, opening means (16) may be incorporated into bag (9) on one edge which has pre-established seal (10). This may be accomplished prior to substantially surrounding either compressible item (1) or initially compressed item (3) by insertion into bag (9). Thus the opening means may be integral to bag (9) and located along one of the edges. Again, this can be done through manufacture of bag (9) so that the actual packaging of compressible item (1) is not further complicated. Alternatively the particular sealing means (13) or other aspects of low pressure chamber (6) might be designed so as to allow simple opening by the consumer. Thus consumer may rip open flexible impermeable encasing (5) upon which fully compressed item (2) expands to an initially compressed state. Initially compressed item (3) may then be easily removed from bag (9) due to inner wrapping (8). It may then be unwrapped to its fully uncompressed state so the consumer may then enjoy the item for its intended use and discard of bag (9) and inner wrapping (8). The item would thus be compressed upon packaging and remain that way through shipment, storage and other facets (collectively referred to as "shipment") for ultimate enjoyment by the consumer. Alternatively, it would be possible to package items so that the retailer might open them and dispose of the impermeable encasing and display them in their uncompressed state. This might be particularly advantageous when packaging more than one item in a single package.

As should be appreciated the various aspects of the embodiments described may be combined in different ways. Naturally compression can occur externally or through an evacuation means. This may be included with an inner wrapping or not. Further, sealing prior to compressing may or may not occur as well. Again, it is intended that the broad scope of this patent encompass all various permutations and combinations since each may be dependent on or selected for particular applications involved.

The foregoing discussion and the claims which follow describe the preferred embodiments of the present invention. Particularly with respect to the claims, it should be understood that changes may be made without departing from the essence of the invention. In this regard, it is intended that such changes would still fall within the scope of the patent. It simply is not practical to describe and claim all possible revisions to the present invention which may be accomplished. To the extent any revision utilizes the essence of any one of the features of the present invention, it would naturally fall within the breadth of protection encompassed by this patent. This is particularly true for the present invention since its basic concepts and understandings are fundamental in nature and can be broadly applied. Any changes or modifications made without departing from the broad aspects of the present invention are intended to be encompassed by this patent.

We claim:

1. A foam pet product package comprising:

a) a foam pet product having an initial volume wherein the foam pet product is established in a reduced volume state of at least about 80% of said initial volume and having substantially no compressible open cell foam having a density than 1.2 pounds per cubic foot, b) a flexible impermeable encasing substantially surrounding the foam pet product, c) a seal to which the flexible impermeable encasing is responsive and which acts to hold the compressible item in its reduced-volume state through interaction between said impermeable encasing and the ambient pressure environment.

2. A foam pet product package as described in claim 1 wherein said impermeable encasing comprises a container capable of defining a plurality of edges and having a pre-established seal along some of said edges.

3. A foam pet product package as described in claim 2 wherein said flexible impermeable encasing comprises an integral opening means.

4. A foam pet product package as described in claim 3 wherein said integral opening means is located along one of the edges having a pre-established seal.

5. A foam pet product package as described in claim 1 or 3 wherein said foam pet product package comprises a plurality of compressible products assembled for single packaging.

6. A reduced-volume package for shipment at an ambient pressure comprising:

a. a compressible item wherein the compressible item is established in a reduced-volume state and has an outer boundary surface;

b. a flexible impermeable encasing substantially surrounding the compressible item throughout said outer boundary; and c. an open inner wrapping established between the compressible item and the flexible impermeable encasing along a portion of said outer boundary.

7. A reduced-volume package as described in claim 6 wherein said compressible item comprises an open cell foam and has substantially no compressible open cell foam having a density less than 1.2 pounds per cubic foot.

8. A reduced-volume package as described in claim 6, or 7 wherein said inner wrapping comprises a material which exhibits low friction with respect to said impermeable encasing.

9. A reduced-volume package as described in claim 6, or 7 wherein said inner wrapping comprises a material which exhibits high friction with respect to itself.

10. A reduced-volume package as described in claim 8 wherein said inner wrapping further comprises a material which exhibits high friction with respect to itself.

11. A reduced-volume package as described in claim 6 or 7 wherein said encasing comprises an integral opening means.

12. A reduced-volume package as described in claim 11 wherein said integral opening means is located along one of the edges having a pre-established seal.

13. A reduced-volume package as described in claim 6 wherein said compressible item comprises a plurality of compressible products assembled for single packaging.

14. A reduced-volume package as described in claim 1 wherein said compressible item is folded and has been further established in a reduced-volume state.

15. A reduced-volume package as described in claim 14 wherein said compressible item comprises an open cell foam and has substantially no compressible open cell foam having a density less than 1.2 pounds per cubic foot.

16. A reduced-volume package as described in claim 15 wherein said compressible item is folded wherein said flexible impermeable encasing comprises a bag which has been sized to accommodate not substantially more than the folded compressed item.

17. A reduced-volume package as described in claim 15 or 16 wherein said flexible impermeable encasing comprises an integral opening means.

18. A reduced-volume package as described in claim 17 wherein said integral opening means is located along one of the edges having a pre-established seal.

* * * * *

UNITED STATES PATENT AND TRADEMARK OFFICE

CERTIFICATE OF CORRECTION

PATENT NO. : 5,445,275
DATED : August 29, 1995
INVENTOR(S) : Curley, et al.

It is certified that error appears in the above-indentified patent and that said Letters Patent is hereby corrected as shown below:

Column 11, line 6, after "density", insert --less--

Signed and Sealed this

Eighteenth Day of February, 1997

*Attest:*

*Attesting Officer*

BRUCE LEHMAN

*Commissioner of Patents and Trademarks*